US007891427B2

(12) United States Patent
Tuk et al.

(10) Patent No.: US 7,891,427 B2
(45) Date of Patent: Feb. 22, 2011

(54) SYSTEM AND METHOD FOR MANAGEMENT OF STEAM FLOODING FOR OIL WELLS

(75) Inventors: David William Tuk, Fairfield, CA (US); James Richard Ouimette, Bakersfield, CA (US); James Lee Brink, Bakersfield, CA (US); Christopher Angelo, Bakersfield, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 954 days.

(21) Appl. No.: 11/818,941

(22) Filed: Apr. 10, 2007
(Under 37 CFR 1.47)

(65) Prior Publication Data

US 2009/0229818 A1 Sep. 17, 2009

Related U.S. Application Data

(60) Provisional application No. 60/791,485, filed on Apr. 11, 2006.

(51) Int. Cl.
*E21B 43/24* (2006.01)
*E21B 36/00* (2006.01)
*E21B 47/06* (2006.01)

(52) U.S. Cl. ..... 166/303; 166/250.06; 166/272.3; 73/152.13; 374/136; 702/6

(58) Field of Classification Search ..... 166/245, 166/268, 272.3, 303, 250.08, 252.4, 252.1; 702/6, 11; 703/10; 73/152.12, 152.13; 374/136
See application file for complete search history.

(56) References Cited

U.S. PATENT DOCUMENTS

| | | | | |
|---|---|---|---|---|
| 3,372,750 | A * | 3/1968 | Satter et al. | 166/272.3 |
| 3,385,360 | A * | 5/1968 | Smith | 166/272.3 |
| 3,938,383 | A * | 2/1976 | Sayer | 73/152.13 |
| 4,265,310 | A * | 5/1981 | Britton et al. | 166/259 |
| 4,501,325 | A * | 2/1985 | Frazier et al. | 166/250.01 |
| 5,246,071 | A * | 9/1993 | Chu | 166/245 |
| 2003/0110017 | A1 * | 6/2003 | Guthrie et al. | 703/2 |
| 2007/0168170 | A1 * | 7/2007 | Thomas | 703/10 |

OTHER PUBLICATIONS

C.H. Neuman, A Mathematical Model of the Steam Drive Process—Applications, American Institute of Mining, Metallurgical, and Petroleum Engineers, Inc., ©Copyright 1975, pp. 1-18, Society of Petroleum Engineers, Paper No. SPE 4757.

J.V. Vogel, Simplified Heat Calculations for Steamfloods, Society of Petroleum Engineers of AIME, ©Copyright 1984, pp. 1-10, Paper No. 0149-2136/84/0071-1219.

* cited by examiner

*Primary Examiner*—Kenneth Thompson
(74) *Attorney, Agent, or Firm*—Timothy J. Hadlock

(57) ABSTRACT

The invention includes a method for determining a steam injection schedule for a set of subsurface formation subsurface regions of an oil field, the method including the steps of determining a thermal maturity for each subsurface region of the set; calculating a latent heat target for each subsurface region according to the determined thermal maturity therefore; calculating a steam injection target for each subsurface region according to the calculated latent heat target therefore; determining the availability of steam for injection to the subsurface regions; and calculating a steam injection schedule for each subsurface region according to the determined steam availability and calculated steam injection targets for all subsurface regions of the set.

18 Claims, 12 Drawing Sheets

Level 1 DFD – Determine Thermal Maturity Process 1.0, Page 2

Level 2 DFD – Determine Thermal Maturity Process 1.0, Page 3

600

Level 2 DFD – Determine Thermal Maturity Process 1.0, Page 4

700

Level 2 DFD – Determine Thermal Maturity Process 1.0, Page 5

Level 2 DFD – Determine Thermal Maturity Process 1.0, Page 6

Level 2 DFD – Determine Thermal Maturity Process 1.0, Page 7

Level 1 DFD – Determine Latent Heat Target Process 2.0

1200

Exemplary Constant Steaming Schedule

| 1210 Well No. | 1215 Well Name | 1220 Steam Rate | 1225 Steam Quality (%Vapor) | 1230 Valve or Chock Setting |
|---|---|---|---|---|
| 1 | A | X Barrels/Day | 40% | 1 |
| 2 | B | Y Barrels/Day | 45% | 2 |
| 3 | C | Z Barrels/Day | 50% | 3 |
| N | D | AA Barrels/Day | 55% | 4 |

1235

Start Steam Date = XX/yy/NNNN

Fig. 12

SYSTEM AND METHOD FOR MANAGEMENT OF STEAM FLOODING FOR OIL WELLS

COPYRIGHT NOTICE AND AUTHORIZATION

This patent document contains material which is subject to copyright protection.

(C) Copyright 2007. Chevron U.S.A. Inc. All rights reserved.

With respect to this material which is subject to copyright protection. The owner, Chevron U.S.A. Inc., has no objection to the facsimile reproduction by any one of the patent disclosure, as it appears in the Patent and Trademark Office patent files or records of any country, but otherwise reserves all rights whatsoever.

FIELD OF THE INVENTION

The present invention relates to the use of steam for increasing oil recovery in fields characterized by a high viscosity crude oil.

BACKGROUND OF THE INVENTION

Steam flooding is a method of increasing oil recovery from an oil field where the oil has a high viscosity. The high viscosity slows or prevents flow of oil thus inhibiting its recovery. Steam flooding greatly reduces the viscosity of the crude oil so that it can now flow from the reservoir into the production wells.

Typically, in steam flood operations the steam generators are not completely automated. Additionally, there is no steam flood operation where the latent heat targets are used for the control of steam generation or steam distribution, and there is no place where steam generation and distribution controls are integrated. In summary, a need exists for complete integration and automation of the controls of steam generation and distribution driven by heat management design. Throughout the life of a steam flood project, steam generation and distribution need to be optimized to ensure that each injection well rate (and cyclic heat delivered to the reservoir to promote production) proceeds along the trajectory necessary to provide the appropriate latent heat to each part of the reservoir. Executing this reliably and efficiently, day in and day out, will increase the probability that a steam flood project achieves its planned operational efficiency and production.

This invention overcomes the above-described shortcomings of known methods and systems.

SUMMARY OF THE INVENTION

In one aspect, the present invention is a method for determining a steam injection schedule for a set of subsurface formation regions (or patterns) of an oil field, the method including the steps of: determining a thermal maturity for each subsurface region of the set; calculating a latent heat target for each subsurface region according to the determined thermal maturity therefore; calculating a steam injection target for each subsurface region according to the calculated latent heat target therefore; determining the availability of steam for injection to the subsurface regions; and calculating a steam injection schedule for each subsurface region according to the determined steam availability and calculated steam injection targets for all subsurface regions of the set.

Another aspect of the invention provides a system for determining a steam injection schedule for a set of subsurface formation regions of an oil field, the system including: a CPU; a memory operatively connected to the CPU, the memory containing a program adapted to be executed by the CPU; the program configured and adapted for: determining a thermal maturity for each subsurface region of the set; calculating a latent heat target for each subsurface region according to the determined thermal maturity therefore; calculating a steam injection target for each subsurface region according to the calculated latent heat target therefore; determining the availability of steam for injection to the subsurface regions; and calculating a steam injection schedule for each subsurface region according to the determined steam availability and calculated steam injection targets for all subsurface regions of the set. So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

BRIEF DESCRIPTION OF THE DRAWINGS

FIG. 12 depicts an exemplary constant steam injection schedule.

DETAILED DESCRIPTION OF PREFERRED EMBODIMENTS

Overview

The major components (also interchangeably called aspects, subsystems, modules, functions, services) of the system and method of the invention, and examples of advantages they provide, are described below with reference to the figures. For figures including process/means blocks, each block, separately of in combination, is alternatively computer implemented, computer assisted, and/or human implemented. Computer implementation optionally includes one or more conventional general purpose computers having a processor, memory, storage, input devices, output devices and/or conventional networking devices, protocols, and/or conventional client-server hardware and software. Where any block or combination of blocks is computer implemented, it is done optionally by conventional means, whereby one skilled in the art of computer implementation could utilize conventional algorithms, components, and devices to implement the requirements and design of the invention provided herein. However, the invention also includes any new, unconventional implementation means.

The System

Figure 1:
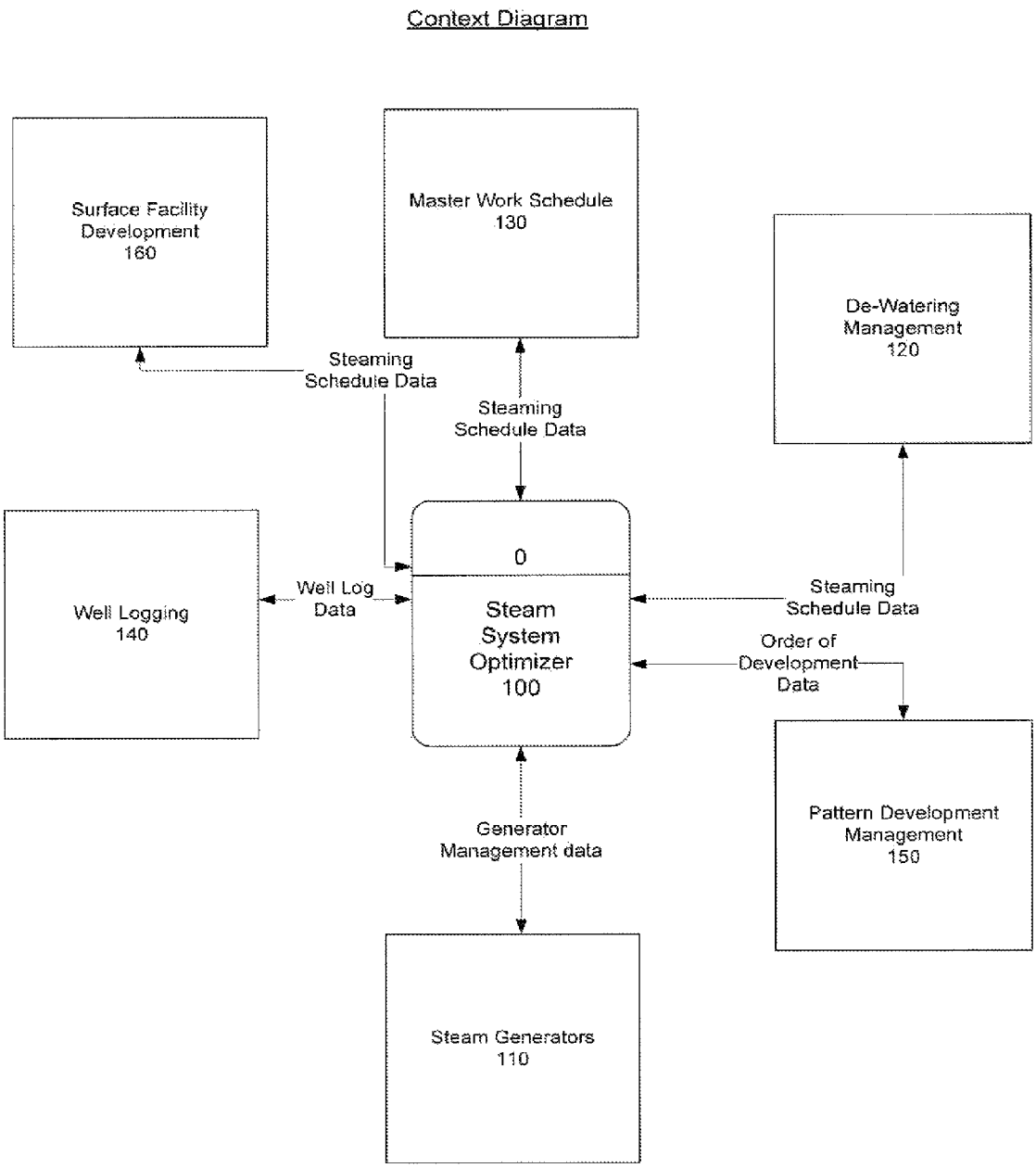
FIG. 1 is a schematic context diagram showing the environment of the invention and its relationship to other systems.

FIG. 1 is a schematic context diagram showing the environment of the invention and its relationship to other systems. Steam System Optimizer Process 100 interacts with several other systems or entities. Several processes/entities receive data from and send data to Steam System Optimizer Process 100. Steaming schedule data passes from Steam System Optimizer Process 100 to Master Work Schedule Process 130 so that work tasks necessary to implement the steaming schedule can be scheduled. Steaming schedule data passes from Steam System Optimizer Process 100 to De-Watering Management Process 120 so that de-watering work tasks necessary to implement the steaming schedule can be scheduled. Steaming schedule data passes from Steam System Optimizer Process 100 to Surface Facility Development processes 160 so that surface facility work tasks necessary to implement the steaming schedule can be scheduled. These same external systems send results back to Steam System Optimizer Process 100 for calibration to keep it synchronized with actual field results.

Several processes/entities provide data to Steam System Optimizer Process 100. Subsurface region development data passes from Subsurface region Development (or Pattern Development) Management Process 150 to Steam System Optimizer Process 100 so that it can be taken into account in optimizing the steam system. Generator Management data passes from Generator Management Processes (Steam Generators) 110 to Steam System Optimizer Process 100 so that it can be taken into account in optimizing the steam system. Generator management data passes from Well-Logging Processes 140 to Steam System Optimizer Process 100 so that it can be taken into account in optimizing the steam system. These same external systems will accept schedule information from Steam System Optimizer Process 100.

Figure 2:
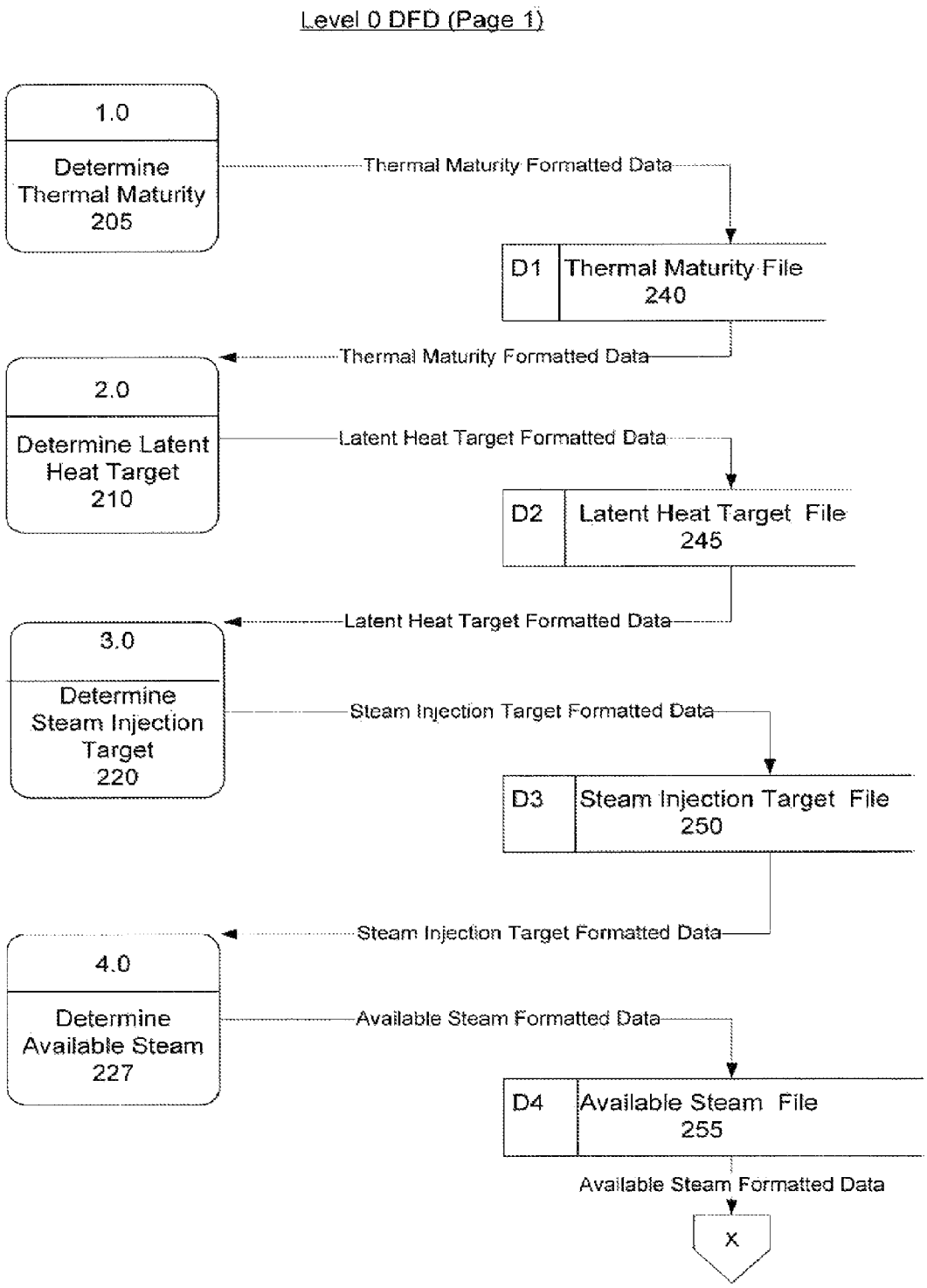
FIGS. 2-3 depict a schematic system level 0 data flow diagram of one embodiment of the invention and show the major process and logical data flow between the major processes.
Figure 3:
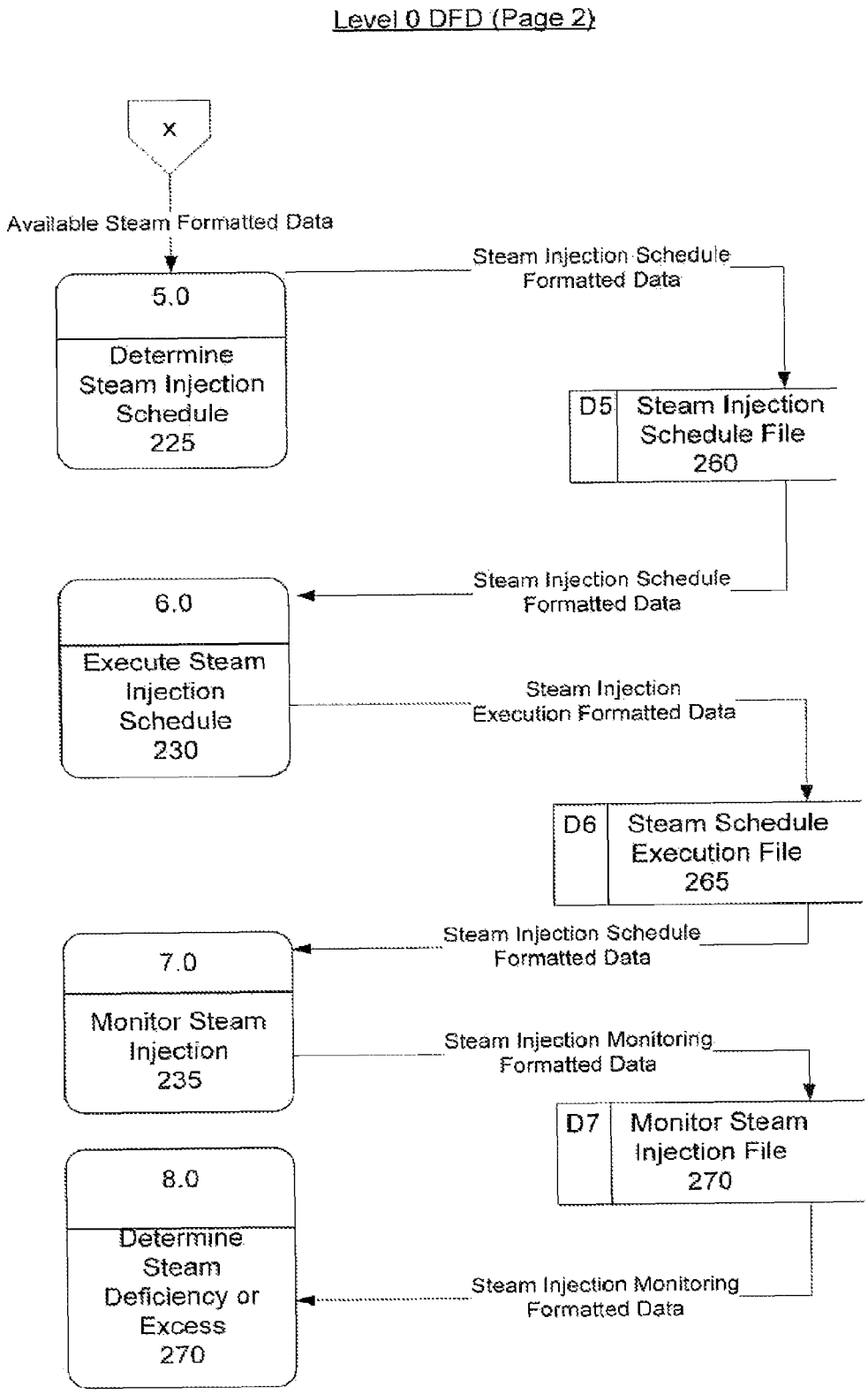

FIGS. 2-3 depict a schematic block system level 0 data, flow diagram of one embodiment of the invention and show the major process and logical data flow between the major processes. Determine Thermal Maturity process 205 passes output to Thermal Maturity File 240. The output is an indication of thermally mature or not.

Determine Latent Heat Target process 210 retrieves the Determine Thermal Maturity process 205 output as formatted data from Thermal Maturity File 240 and passes its own output to Latent Heat Target File 245. The output from Determine Latent Heat Process 210 is a value having units of BTU's, or other units measuring of heat, to be delivered to the subsurface region. Determine Steam Injection Target process 220 retrieves Determine Latent Heat Target process 210 output as formatted data from Latent Heat Target File 245 and passes its own output to Steam Injection Target File 250. The output is a target barrels of steam to be delivered to each subsurface region.

Determine Available Steam process 227 retrieves Determine Steam Injection Target process 220 output as formatted data from Steam Injection Target File 250 and passes its own output to Available Steam File 255. The output is a table or other structured or unstructured data indicating steam availability over a time period of interest for each subsurface region of interest. Determine Steam Injection Schedule process 225 retrieves Determine Available Steam process 227 output as formatted data from Available Steam File 255 and passes its own output to Steam Injection Schedule File 260. The output is a steam injection schedule. Given a latent heat target for one or more subsurface regions, available steam, along with other system constraints, Determine Steam Injection Schedule process 225 prepares a steaming schedule for a pre-determined time period, e.g., number of days, weeks, or months. Various methods can be used to prepare a schedule based on pre-determined criteria, e.g., desired time to reach thermal maturity for each subsurface region. Methods of preparing a cyclic steaming schedule are described in U.S. Pat. No. 6,446,721, entitled System and method for scheduling cyclic steaming of wells, assigned to Chevron U.S.A. Inc., which is incorporated herein by reference in its entirety. Methods of preparing a non-cyclic steaming schedule are described in U.S. Pat. No. 5,174,377, entitled Method for optimizing steam flood performance, assigned to Chevron Research and Technology Company, which is incorporated herein by reference in its entirety.

Execute Steam Injection Schedule process 230 retrieves Determine Steam Injection Schedule process 225 output as formatted data from Steam Injection Schedule 260 and passes its own output to Steam Schedule Execution File 265. The output is a list or schedule of tasks and operating procedures necessary to execute the steam schedule. Monitor Steam Injection process 235 retrieves Execute Steam Injection Schedule process 230 output as formatted data from Steam Schedule Execution Schedule 265 and passes its own output to Monitor Steam Injection File 270. The output is a historical report of steam delivered to each subsurface region and each well within a subsurface region. Determine Steam Deficiency/Excess process 270 retrieves Monitor Steam Injection process 235 output as formatted data from Monitor Steam Injection File 270. The output indicates any variances between the steam scheduled to be delivered and the steam actually delivered.

FIGS. 4-10 depict a schematic level 1 data flow diagram (a first decomposition of one process in the level 0 data flow diagram in FIG. 2) and show the processes and logical data flow between the processes of the Determine Thermal Maturity process 205.

Figure 4A:
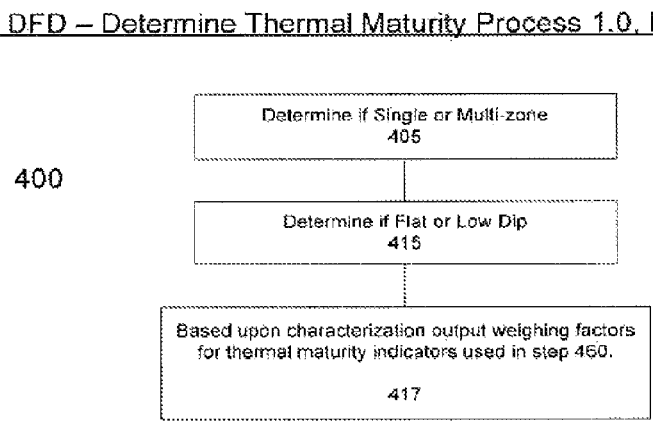
FIGS. 4-10 depict a schematic level 1 or 2 data flow diagram (a first or second decomposition of one process in the level 0 data flow diagram in FIG. 2, or others) and show the processes and logical data flow between the processes of the Determine Thermal Maturity process 1.0.

FIG. 4*a* depicts a preferred embodiment of the overall Determine Thermal Maturity Process 205. First (process 400) determine in steps 405 and 415 the reservoir type, i.e., if a single or multi-zone reservoir (step 405) and whether the reservoir is flat or dipping (step 415). This output will be used (step 417) in assigning weighting to thermal maturity indicators in step 460.

Figure 4B:
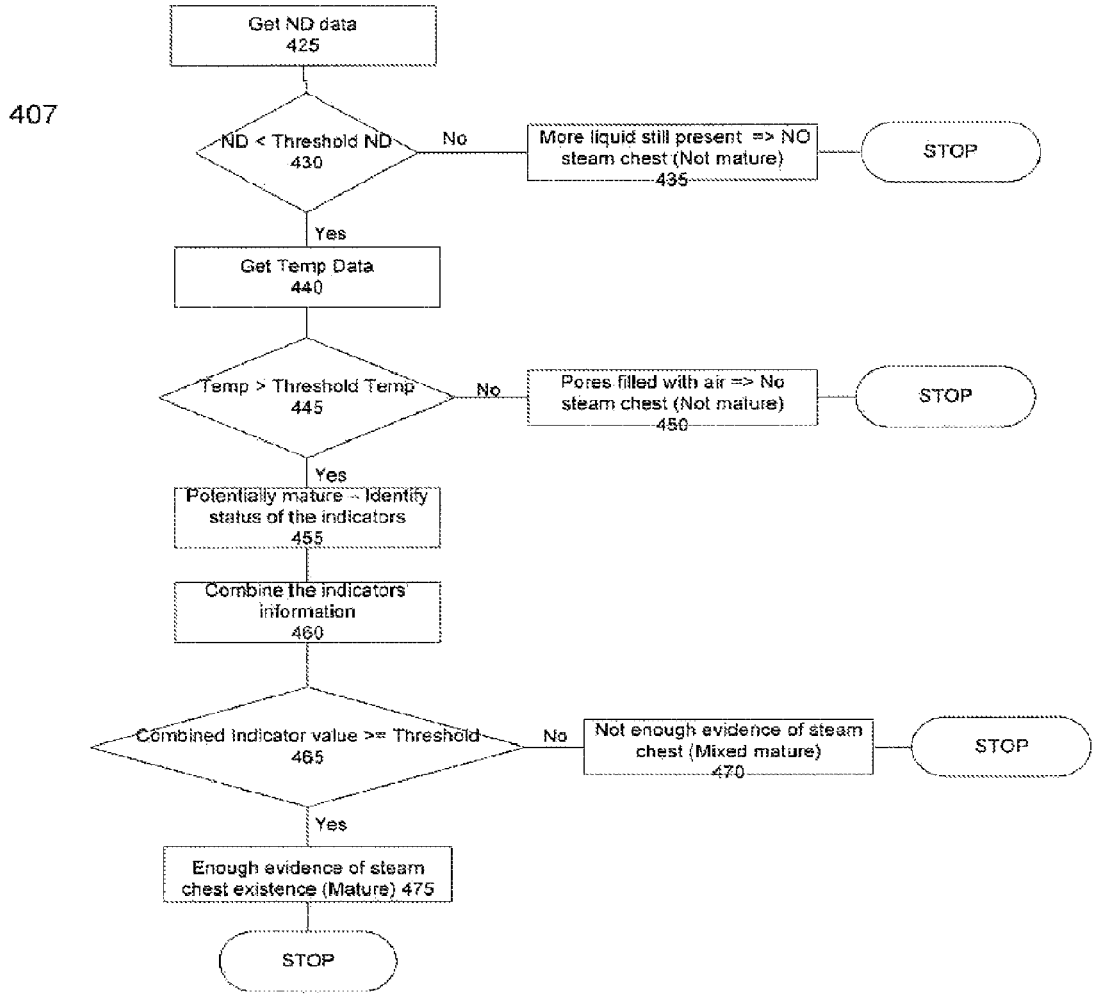

In FIG. 4*b*, then (process 407) retrieve the latest neutron density ("ND"). Neutron density is dimensionless. If the ND is less than a predetermined threshold (step 430), then get temperature data (step 440). If the ND is not less then the pre-determined threshold then this indicates more liquid is present and there is no steam chest, thus the subsurface region is not thermally mature (step 435). The pre-determined threshold temperature is determined, e.g., by identifying the saturation temperature of steam at the prevailing reservoir pressure. The temperature is retrieved via a query to a temperature survey database.

After getting the temperature data from well logging data (step 440), determine if the temperature is above a pre-determined threshold (step 445). If not, then this indicates pores are filled with air and there is no steam chest, thus the subsurface region is not thermally mature (step 450). If the temperature is above a pre-determined threshold (step 445), then the subsurface region potentially thermally mature and the indicator status should be identified (step 455) and combined (step 460) by averaging them with appropriate weights. "Indicator status" refers to the indicator supporting the pattern being mature or immature.

Then determine if the combined indicator value is at least at a pre-determined threshold (step 465). If not, then this indicates there is not enough evidence of a steam chest and the subsurface region is at most of mixed maturity (step 470). If yes, the there is sufficient evidence of thermal maturity (step 475).

Figure 5:
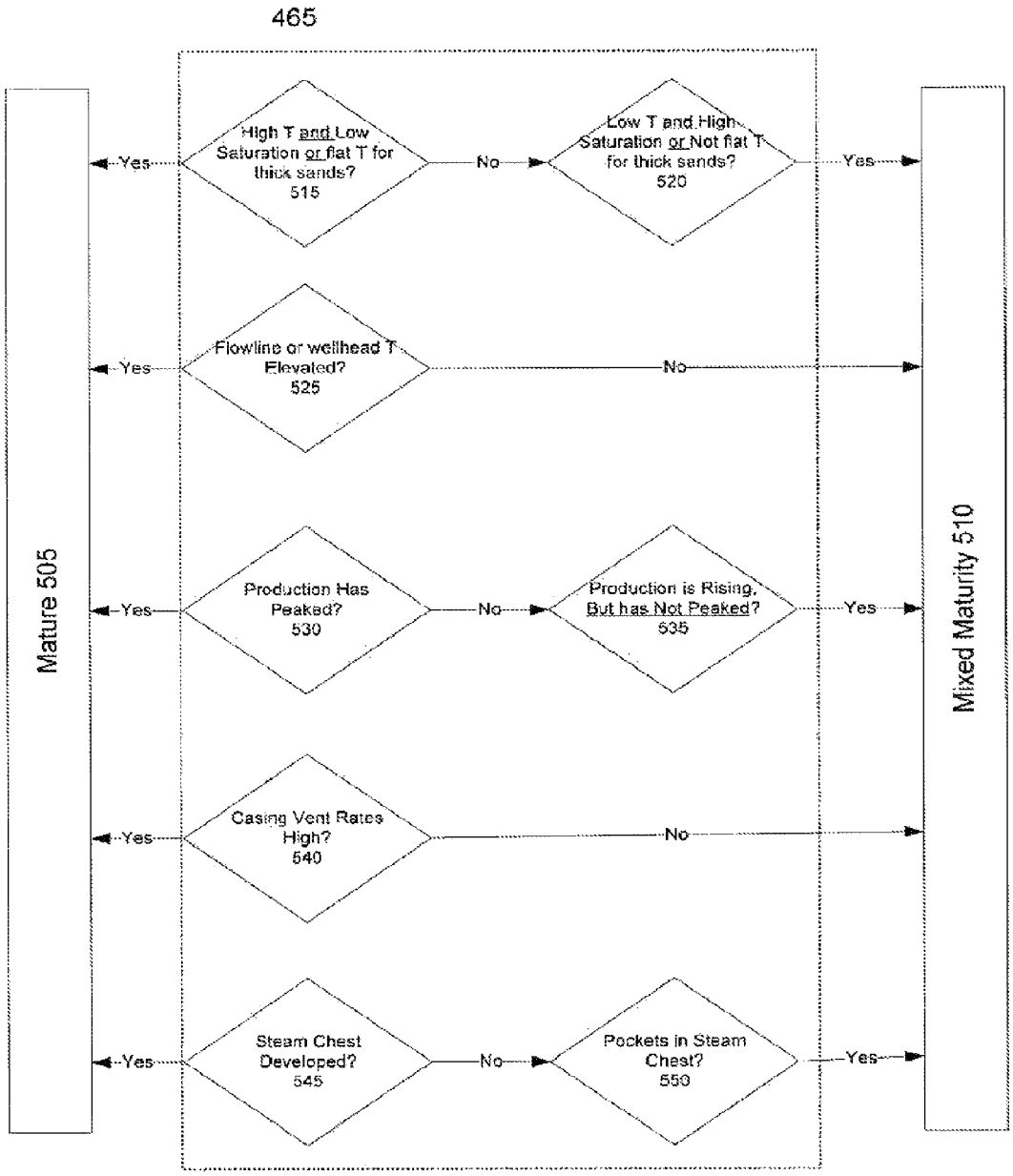

FIG. 5 provides a preferred embodiment of a first deconstruction view determining the combined indicator value (step 455)—showing specific indicators. FIGS. 6-11 provide a preferred embodiment of a second deconstruction view of the individual indicators in FIG. 5. Five indicator categories are shown in FIG. 5. The first one listed is to determine if high temperature and low saturation or flat temperature for thick sands (step 515). If yes, this indicates thermal maturity 505. If not then determine if low temperature and high saturation or not flat temperature for thick sands (step 520). If yes, then this indicates a mixed maturity 510. The determination of whether there is a high temperature and low saturation is by user specified thresholds. "High" temperature means higher than the user specified threshold. "Low" saturation means lower than the user specified threshold.

The next listed indicator is to determine if the flow line or wellhead temperature is elevated (step 525). This is determined by measuring the temperature of flowing fluid at the wellhead. An "elevated" wellhead temperature in this context means higher than the user specified threshold. If yes, this indicates thermal maturity 505. If not, this indicates mixed thermal maturity 510. The next listed indicator is to determine if production has peaked (step 530). If yes, this indicates thermal maturity 505. If not, this indicates mixed thermal maturity 510. The next listed indicator is to determine if case vent rates are high (step 540). This is determined by user specified thresholds. "High" case vent rates in this context means higher than the user specified threshold. If yes, this indicates thermal maturity 505. If not, this indicates mixed thermal maturity 510. The next listed indicator is to determine if a steam chest has developed (step 545). This is determined by an earth model. A "developed" steam chest means presence of steam at the top of the zone of consideration. If yes, this indicates thermal maturity 505. If not, then check if there are pockets in the steam chest (step 550). If not, this indicates mixed thermal maturity 510.

Figure 6:
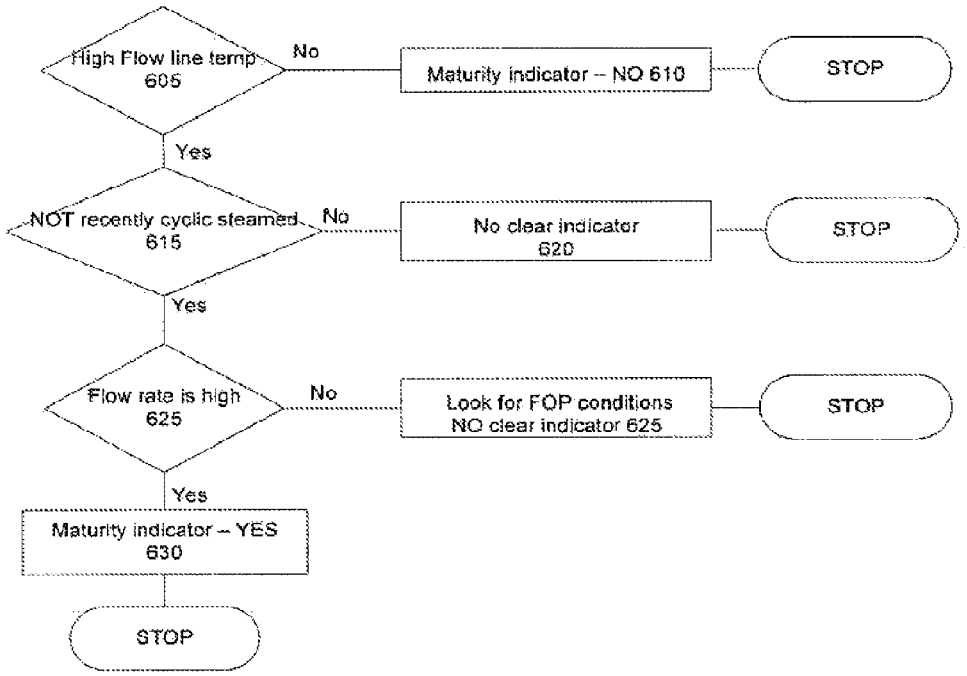

FIG. 6 depicts in one embodiment a further decomposition 600 of the Determine if Flow line or Wellhead Temperature is Elevated indicator 525 (FIG. 5). This is applicable in single-reservoir projects. First, for a given subsurface region retrieve the flow line temperature for associated wells and determine if it is high (step 605). This is determined by user specified thresholds. A "high" flow line temperature in this context means higher than specified threshold. If not, this indicates not thermal mature (step 610). If yes, validate whether the temperature can be used by determining if the well has not been recently steamed (step 615). If it has been recently steamed, then the temperature data cannot be used to indicate thermal maturity, so there is not a clear indicator of thermal maturity (step 620). If not recently steamed, determine if the flow rate is high (step 625), i.e., is it adequate when compared to the predicted production rate. If the flow rate is high (step 625), then this indicates thermal maturity (step 630). If not, there is no clear indicator of thermal maturity (step 625). As a follow-up it is recommended to look for FOP (fluid over pump) conditions.

Figure 7:
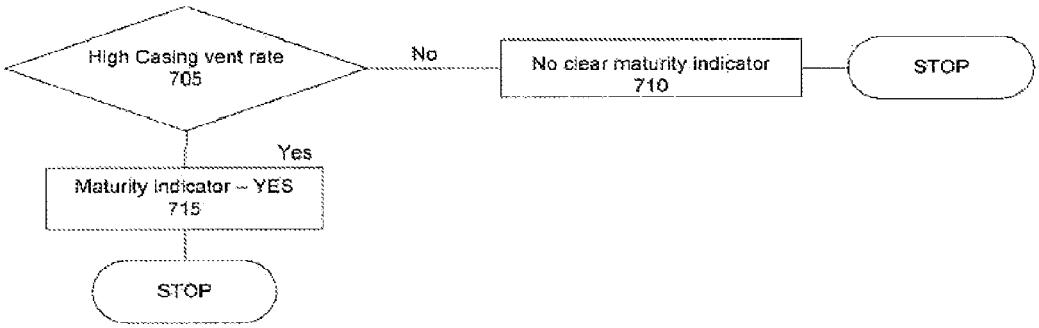

FIG. 7 depicts in one embodiment a further decomposition 700 of the Determine if Casing Vent Rates are High indicator 540 (FIG. 5). This is applicable in single-reservoir projects. If the casing vent rate is not high when compared to the well baseline value (step 705), then there is no clear indicator of thermal maturity (step 710). If the casing vent rate is high, then this indicates thermal maturity (step 715).

Figure 8:
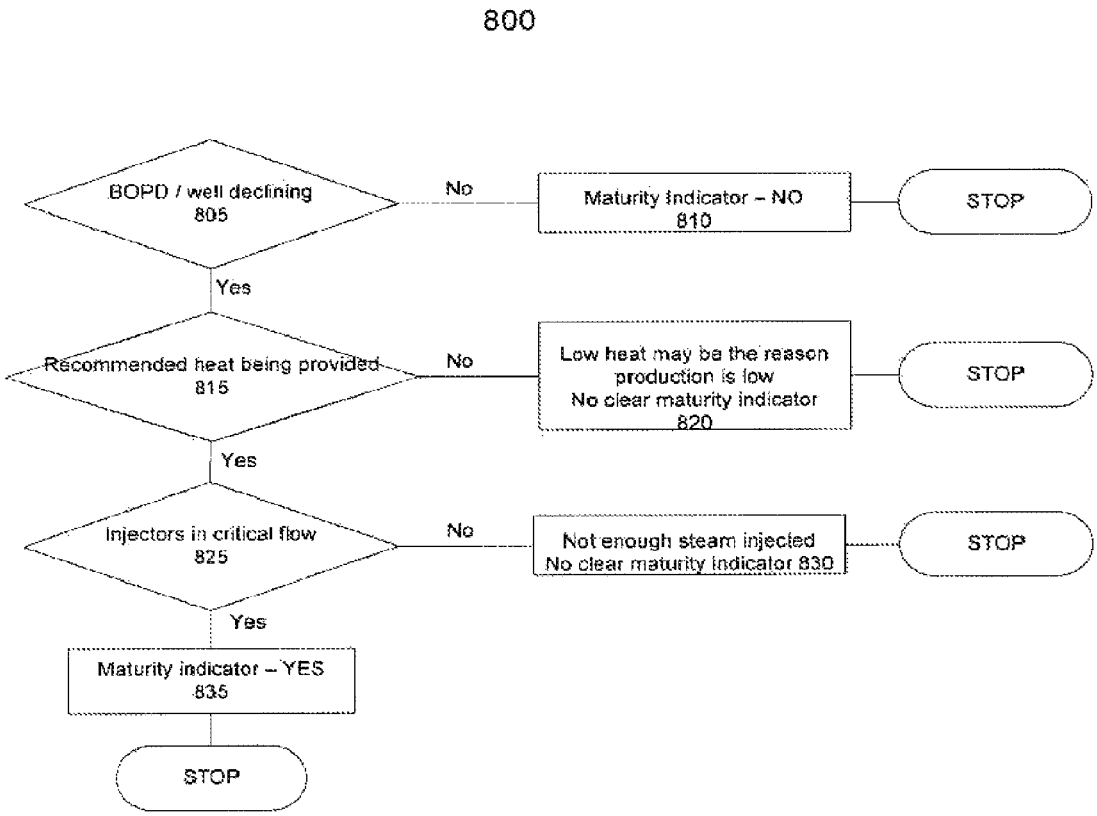

FIG. 8 depicts in one embodiment a further decomposition 800 of the Determine if the Production has Peaked indicator 530 (FIG. 5). First, determine if the barrels of production per day per well is declining (step 805). This is determined by applying change point analysis to monthly production data. If no, then there is no clear indicator of thermal maturity (step 810). If it is declining (step 805), then determine if the recommended heat is being provided (step 815), i.e., enough heat to reach thermal maturity. "Recommended heat" in this context means the targeted pattern level injection rate. If no, then low heat may be the reason production is low and there is no clear indicator of thermal maturity (step 820). If the recommended heat is being provided (step 815), then validate the heat measurement to ensure the correct physical conditions are being met by determining if the injectors are in critical flow (step 825). If no, then there is not enough steam being injected and there is no clear indicator of thermal maturity (step 830). If the injectors are in critical flow (step 825), this indicates thermal maturity (step 835). This is determined by comparing the pressures upstream and downstream of the orifices. "Critical" flow in this context means fluid is flowing at sonic velocity.

Figure 9:
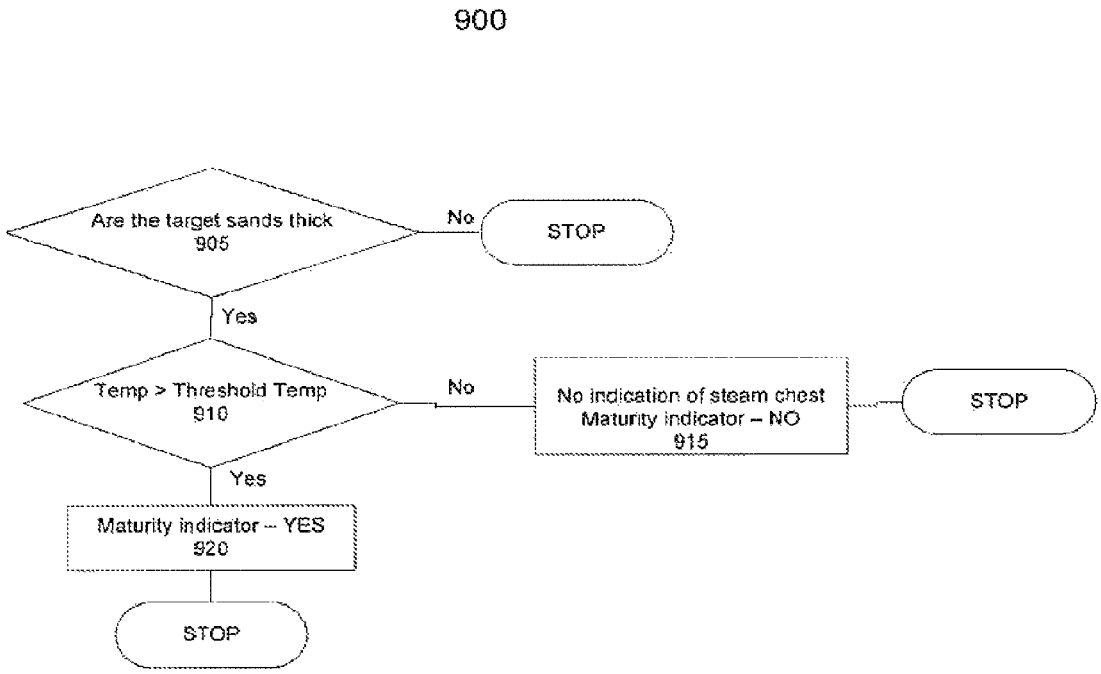

FIG. 9 depicts in one embodiment a further decomposition 900 of the step of determining if high temperature and low saturation or flat temperature for thick sands (step 515). First, determine if the target sands are thick (step 905). This is determined by interpretation of geologic parameters. "Thick" target sands in this context means thicker than a user specified threshold. If yes, then determine if the temperature is greater than a pre-determined threshold temperature (step 910), typically measured in an observation well. This is determined by see above. The pre-determined threshold temperature is determined by user specified parameters. If not, then this measurement is not valid and there is no clear indicator of a steam chest and thermal maturity (step 915). If yes, then this indicates thermal maturity (step 920). The pre-determined threshold temperature is derived from the known reservoir pressure at the observation well.

Figure 10:
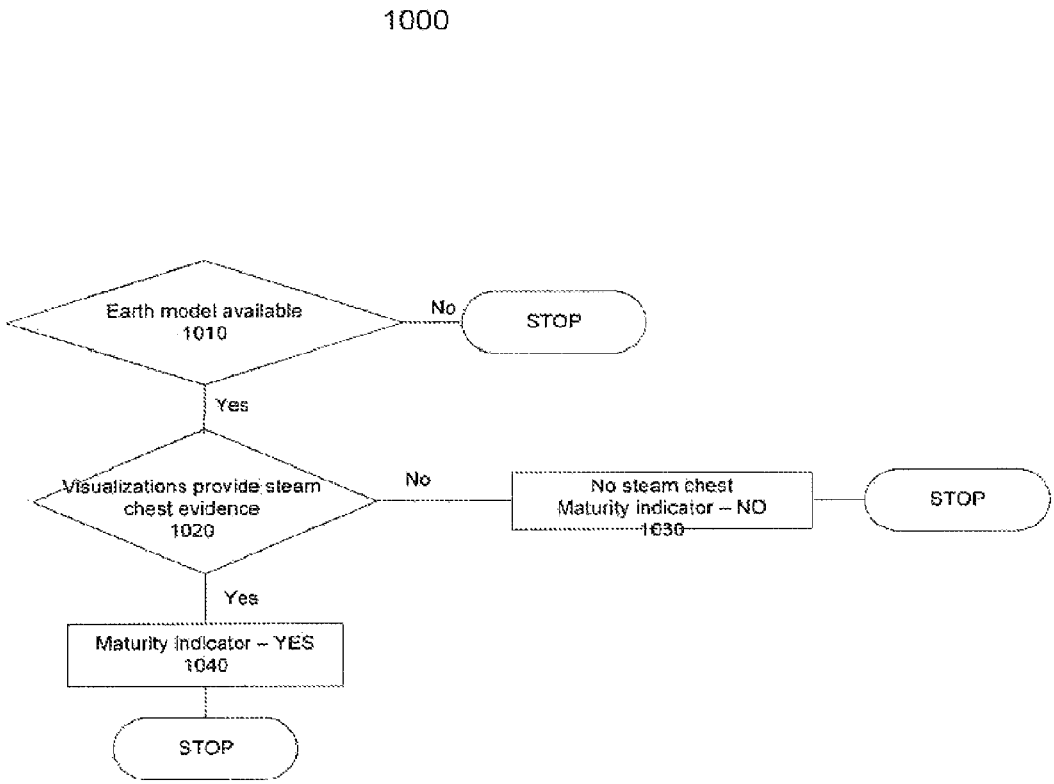

FIG. 10 depicts in one embodiment a further decomposition 1000 of the Determine if a Steam Chest has Developed indicator 545 (FIG. 5). First, determine if an Earth Model, e.g., GOCAD™ brand Earth Model is available (step 1010), i.e., whether an earth model is available that can accept the thermal data. If yes, then read the Earth Model output and determine if visualizations provide evidence of a steam chest (step 1020). This is determined, e.g., by model observation. If not, there is no clear indicator of a steam chest and thermal maturity (step 1030). If yes, then this indicates thermal maturity (step 1040).

Figure 11:
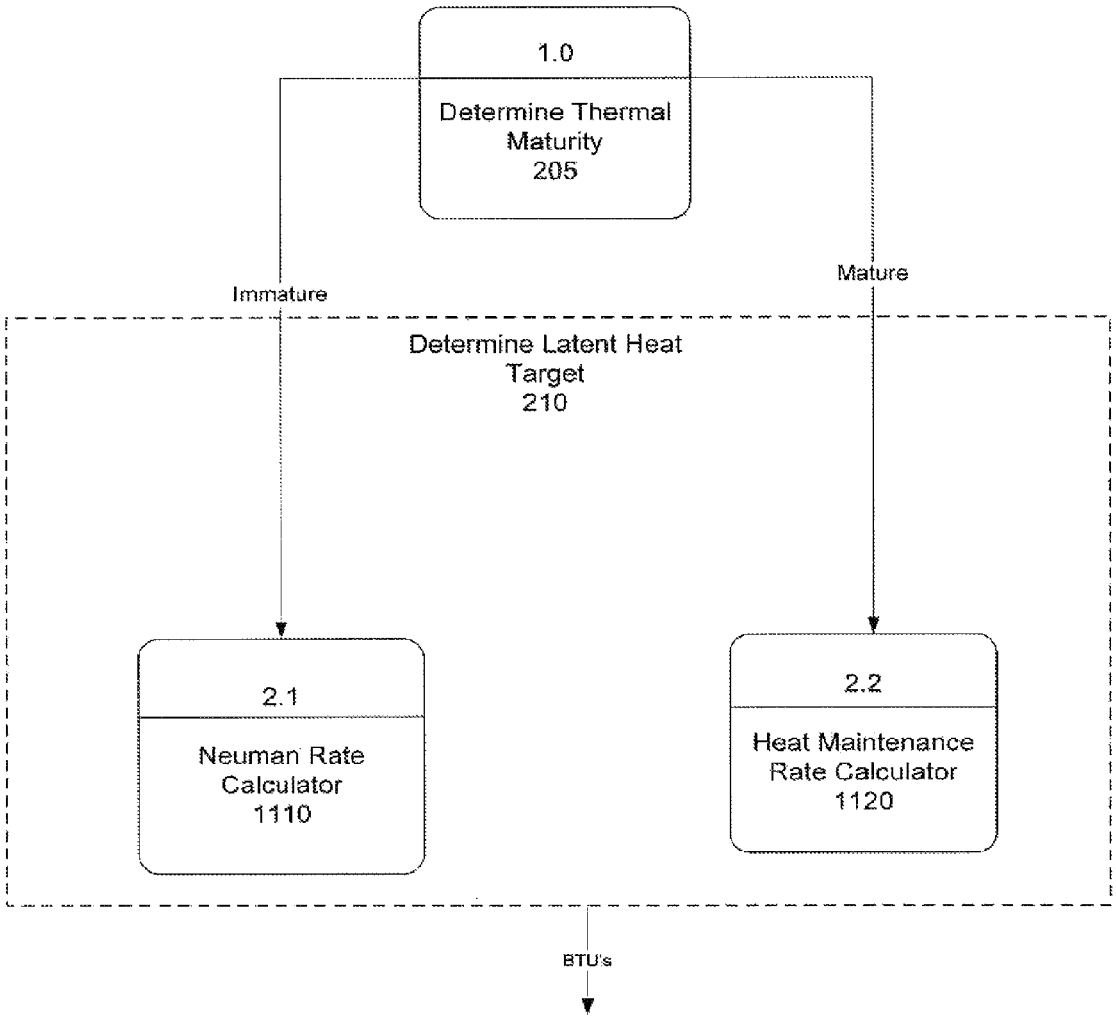
FIG. 11 depicts a schematic level 1 data flow diagram of the processes and logical data flow between the processes of the Determine Latent Heat Target process 2.0.

FIG. 11 depicts a schematic level 1 data flow diagram of the processes and logical data flow between the processes of the Determine Latent Heat Target process 210. The status of either thermally mature on not thermally mature is retrieved by Determine Latent Heat Target process 210. This can be implemented via a thermally mature variable for each subsurface region which is either set or not set, i.e., set being a value of 1 and indicating thermal maturity and not set being a value of 0 indicating not thermally mature. If the thermally mature variable is set, control is passed to Heat Maintenance Rate Calculator process 1120. Otherwise, control is passed to Neumann Rate Calculator process 1110. The output from Determine Latent Heat Process 210 is a value having units of BTU's, or other units measuring of heat, to be delivered to the subsurface region.

The Neuman Rate Calculator utilizes the following equation to determine latent heat target where there is no thermal maturity:

$$Q = \frac{\text{Area}}{\sqrt{\frac{t\alpha}{\pi}}}\left(\frac{7758k\Delta T}{x\rho_w h_{fg}(1-f_p)}\right)$$

The Neuman Rate calculation methodology is further described in detail in the paper entitled *A Mathematical Model of the Steam Drive Process—Applications*, SPE 4757, by C. H. Neuman, which is incorporated herein by reference.

The Heat Maintenance Rate Calculator utilizes the following equation to determine latent heat target where there is thermal maturity:

$$Q_{Tot} = 2\left[\frac{kA(T_{SteamChest} - T_{Initial})}{\sqrt{\pi\alpha\tau}}\left[1 + \left(\frac{h_{f_{F_{Reservoir}}} - h_{f_{T_{bullet}}}}{h_{fg_{F_{Reservoir}}}}\right)\right]\right]$$

The Heat Maintenance Rate calculation methodology is further described in detail in the paper entitled *Simplified Heat Calculations for Steamfloods*, SPE 11219, by J. V. Vogel, which is incorporated herein by reference.

Determine Steam Injection Target process 220 (FIG. 2.) is a calculation. The heat in BTU's from Determine Latent Heat Process 210 is divided by the amount of heat per barrel of steam to determine the needed barrels of steam. Steam quality will vary so this calculation must be updated periodically.

Constraints used in determining Steam Injection Schedule 225 (FIG. 3) include fresh water availability, distribution system limits, well injection limits, steam generator capacity and maintenance schedules, cyclic steam rig availability and well availability for cyclic steaming. Distribution system limits include steam delivery limits of the distribution system header, well choke size or control valve setting, and pipe sizes.

FIG. 12 depicts an exemplary constant steam schedule 1200. Each well is identified in No. column 1210 and name column 1215. The steam rate column 1220 gives steam rates, e.g., barrels per day or other suitable expression of unit volume per unit time. Steam quality column 1225 gives the steam quality in, e.g., percent vapor. Valve/Choke settings 1230 indicates the size, e.g., diameter, of a variable opening at the well head. This setting must typically be changed manually if a change is desired. The date 1235 the new steaming schedule 1200 is to take effect is given, or alternatively, each well may have a separate date field.

Other Implementations

Other embodiments of the present invention and its individual components will become readily apparent to those skilled in the art from the foregoing detailed description. As will be realized, the invention is capable of other and different embodiments, and its several details are capable of modifications in various obvious respects, all without departing from the spirit and the scope of the present invention. Accordingly, the drawings and detailed description are to be regarded as illustrative in nature and not as restrictive. It is therefore not intended that the invention be limited except as indicated by the appended claims.

What is claimed is:

1. A method for determining a steam injection schedule for a set of subsurface regions of an oil field, the method comprising the steps of:

a. determining thermal maturity for each subsurface region of the set;

b. calculating a latent heat target for each subsurface region according to the determined thermal maturity therefore; wherein a Neuman rate calculator is employed to calculate the steam injection targets for thermally immature subsurface regions and wherein a heat maintenance rate calculator is employed to calculate the steam injection targets for thermally mature subsurface regions;

c. calculating a steam injection target for each subsurface region according to the calculated latent heat target therefore;

d. determining the availability of steam for injection to the subsurface regions; and e. calculating a steam injection schedule for each subsurface region according to the determined steam availability and calculated steam injection targets for all subsurface regions of the set.

2. The method of claim 1, further comprising the step of determining an order of development for each subsurface region of the set of subsurface regions of an oil field.

3. The method of claim 1, further comprising the step of injecting steam into each subsurface region according to the steam calculated injection schedule therefore.

4. The method of claim 1, wherein the thermal maturity for each subsurface region of the set is determined by logging operations conducted in observation well bores penetrating the respective subsurface regions.

5. The method of claim 1, further comprising the steps of:

a. monitoring the actual amount of steam injected into each subsurface region; and b. determining a steam injection deficiency by comparing the monitored amount of steam injected to the calculated steam injection target for each subsurface region.

6. The method of claim 5, wherein a latent heat target is calculated for each subsurface region according to the determined thermal maturity and the determined steam injection deficiency therefore.

7. The method of claim 5, further comprising the step of monitoring casing blow indicators.

8. The method of claim 7, wherein a latent heat target is calculated for each subsurface region according to the determined thermal maturity, the determined steam injection deficiency, and the casing blow indicators.

9. The method of claim 1, wherein the step of calculating a steam injection target for each subsurface region comprises calculating at least one of continuous and cyclic steam injection targets based upon the determined subsurface region thermal maturity.

10. The method of claim 1, wherein the step of determining the availability of steam for injection to the subsurface regions comprises the steps of:

a. determining steam generator availability;

b. determining soft water availability; and c. determining steam distribution system constraints.

11. The method of claim 10, wherein the step of determining the availability of steam for injection to the subsurface regions further comprises the step of determining facility maintenance requirements.

12. The method of claim 1, wherein the step of calculating a steam injection target for each subsurface region comprises the steps of:

a. calculating a continuous steam injection schedule;

b. calculating a cyclic steam injection schedule;

c. calculating a steam generator schedule;

d. monitoring the soft water demand over time; and e. determining an observation-well logging schedule for measuring data for determining thermal maturity.

13. A system for determining a steam injection schedule for a set of subsurface formation regions of an oil field, the system comprising:

a. a CPU;

b. a memory operatively connected to the CPU, the memory containing a program adapted to be executed by the CPU;

c. the program configured and adapted for:

i. determining thermal maturity for each subsurface region of the set;

ii. calculating a latent heat target for each subsurface region according to the determined thermal maturity therefore; wherein a Neuman rate calculator is employed to calculate the steam injection targets for thermally immature subsurface regions and wherein a heat maintenance rate calculator is employed to calculate the steam injection targets for thermally mature subsurface regions;

iii. calculating a steam injection target for each subsurface region according to the calculated latent heat target therefore;

iv. determining the availability of steam for injection to the subsurface regions; and v. calculating a steam injection schedule for each subsurface region according to the determined steam availability and calculated steam injection targets for all subsurface regions of the set.

14. The system of claim 13, wherein the program is further configured and adapted for:

a. monitoring the actual amount of steam injected into each subsurface region; and b. determining a steam injection deficiency by comparing the monitored amount of steam injected to the calculated steam injection target for each subsurface region.

15. The system of claim 14, wherein the program is further configured and adapted for monitoring casing blow indicators.

16. The system of claim 13, wherein the program is further configured and adapted for calculating a steam injection target for each subsurface region comprising calculating at least one of continuous and cyclic steam injection targets based upon the determined subsurface region thermal maturity.

17. The system of claim 13, wherein the program is further configured and adapted for determining the availability of steam for injection to the subsurface regions comprising the steps of:

a. determining steam generator availability;

b. determining soft water availability; and c. determining steam distribution system constraints.

18. The system of claim 13, wherein the program is further configured and adapted for calculating a steam injection target for each subsurface region comprising the steps of:

a. calculating a continuous steam injection schedule;

b. calculating a cyclic steam injection schedule;

c. calculating a steam generator schedule;

d. monitoring the soft water demand over time; and e. determining an observation-well logging schedule for measuring data for determining thermal activity.

* * * * *